US010851489B2

(12) United States Patent
Lee et al.

(10) Patent No.: US 10,851,489 B2
(45) Date of Patent: Dec. 1, 2020

(54) LAUNDRY TREATMENT APPARATUS

(71) Applicant: LG Electronics Inc., Seoul (KR)

(72) Inventors: Jihong Lee, Seoul (KR); Yanghwan No, Seoul (KR); Kwanwoong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/554,559

(22) PCT Filed: Feb. 29, 2016

(86) PCT No.: PCT/KR2016/002028
§ 371 (c)(1),
(2) Date: Aug. 30, 2017

(87) PCT Pub. No.: WO2016/140489
PCT Pub. Date: Sep. 9, 2016

(65) Prior Publication Data

US 2018/0057990 A1 Mar. 1, 2018

(30) Foreign Application Priority Data

Mar. 2, 2015 (KR) ..... 10-2015-0028981

(51) Int. Cl.
*D06F 37/22* (2006.01)
*D06F 39/12* (2006.01)
(Continued)

(52) U.S. Cl.
CPC ..... *D06F 37/22* (2013.01); *D06F 37/42* (2013.01); *D06F 39/125* (2013.01); *D06F 39/14* (2013.01);
(Continued)

(58) Field of Classification Search
CPC ..... D06F 37/28; D06F 37/42; D06F 39/14
See application file for complete search history.

(56) References Cited

U.S. PATENT DOCUMENTS 5,257,860 A * 11/1993 Slivon ..... E05B 65/462 312/218
5,722,275 A * 3/1998 Price ..... E05B 13/105 70/360
(Continued)

FOREIGN PATENT DOCUMENTS

EP 2757186 7/2014
KR 10-2008-0065752 7/2008
(Continued)

OTHER PUBLICATIONS

Supplementary European Search Report in European Application No. 16759125.4, dated Sep. 18, 2018, 9 pages.
(Continued)

*Primary Examiner* — Joseph L. Perrin
(74) *Attorney, Agent, or Firm* — Fish & Richardson P.C.

(57) ABSTRACT

A laundry treatment apparatus is disclosed. The laundry treatment apparatus includes a drawer configured to be pulled out from a cabinet, an introduction port provided in the upper surface of the drawer, a drum located in the drawer so as to communicate with the introduction port for providing a laundry receiving space, a driving shaft provided at the bottom surface of the drum, a driving unit for rotating the driving shaft, a push unit provided at the drawer for allowing external force to be applied thereto, a fastening unit performing a linear reciprocating motion in a direction perpendicular to a direction in which the drawer is pulled out for selectively coupling the drawer to the cabinet, and a transfer unit for connecting the push unit and the fastening unit to each other and for separating the fastening unit from the cabinet when external force is applied to the push unit.

12 Claims, 3 Drawing Sheets

(51) Int. Cl.

| | |
|---|---|
| ***D06F 39/14*** | (2006.01) |
| ***D06F 37/42*** | (2006.01) |
| ***D06F 58/20*** | (2006.01) |
| *D06F 37/28* | (2006.01) |
| *D06F 31/00* | (2006.01) |

(52) U.S. Cl.
CPC ..... *D06F 58/20* (2013.01); *D06F 31/00* (2013.01); *D06F 37/28* (2013.01)

(56) References Cited

U.S. PATENT DOCUMENTS

| | | | | |
|---|---|---|---|---|
| 6,722,167 | B1 * | 4/2004 | Hsu | E05B 65/462 292/119 |
| 6,865,911 | B2 * | 3/2005 | Bolduan | D06F 39/02 68/17 R |
| 7,513,132 | B2 | 4/2009 | Wright et al. | |
| 7,624,600 | B2 | 12/2009 | Sunshine et al. | |
| 7,628,043 | B2 | 12/2009 | Sunshine et al. | |
| 9,187,855 | B2 | 11/2015 | Gilboe et al. | |
| 2002/0056720 | A1 | 5/2002 | Youn | |
| 2004/0263032 | A1 * | 12/2004 | Cho | A47B 67/04 312/330.1 |
| 2007/0249212 | A1 * | 10/2007 | Buecker | D06F 39/005 439/369 |
| 2009/0261697 | A1 * | 10/2009 | Hill | D06F 39/02 312/333 |
| 2011/0265524 | A1 * | 11/2011 | Kim | D06F 29/00 68/13 R |

FOREIGN PATENT DOCUMENTS

| | | |
|---|---|---|
| KR | 10-0857799 | 9/2008 |
| KR | 10-2012-0049667 | 5/2012 |
| KR | 10-1319879 | 10/2013 |
| KR | 10-2014-0046181 | 4/2014 |
| KR | 10-1467752 | 12/2014 |

OTHER PUBLICATIONS

International Search Report and Written Opinion in International Application No. PCT/KR2016/002028, dated May 11, 2016, 12 pages (with English translation).

* cited by examiner

[Fig. 1]
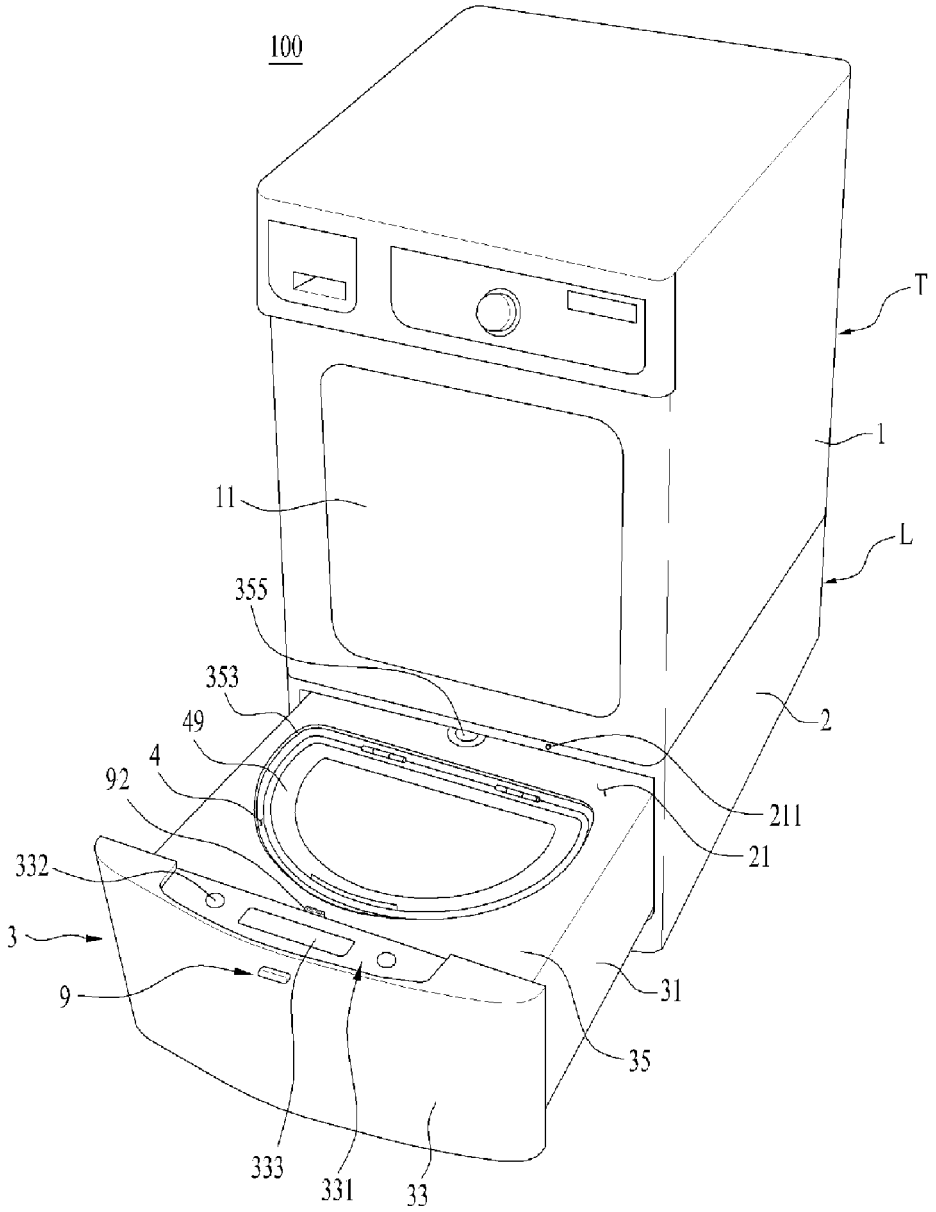

[Fig. 2]
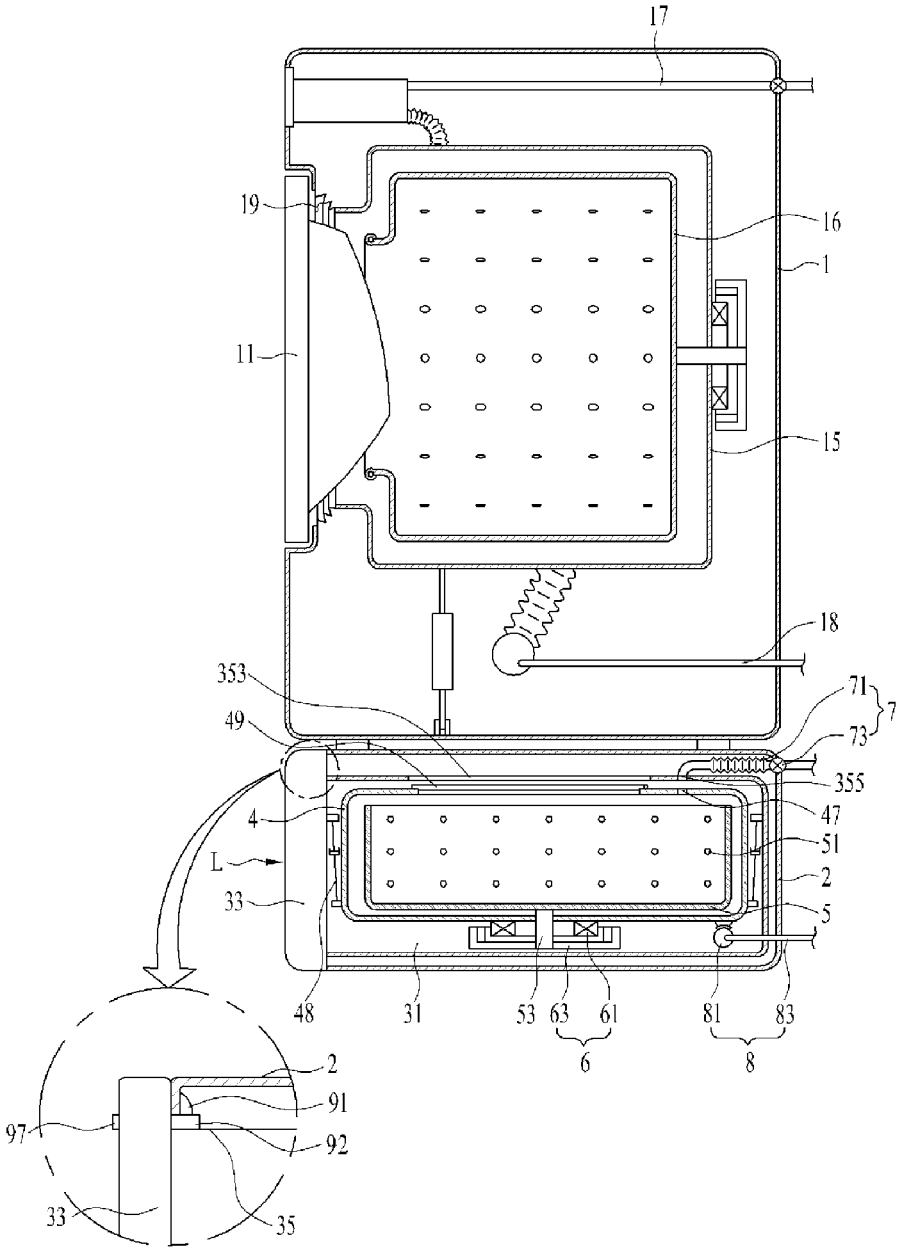

[Fig. 3]
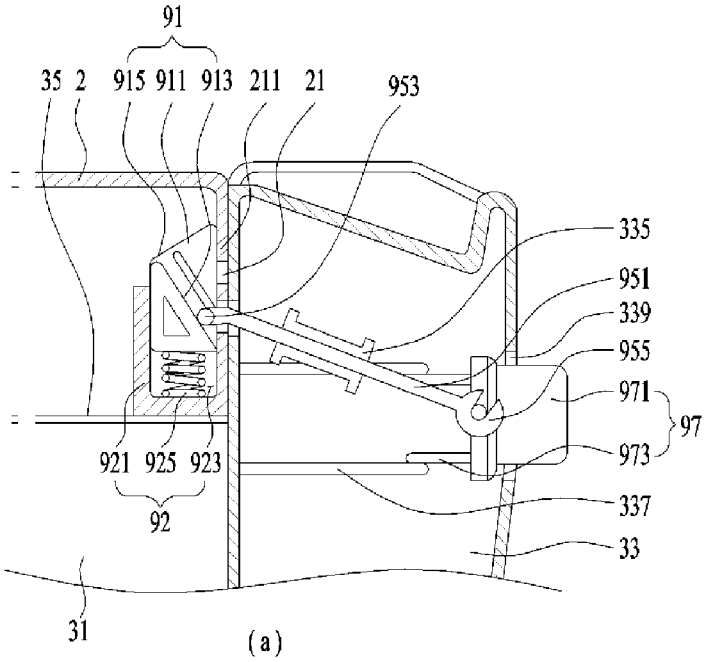
(a)
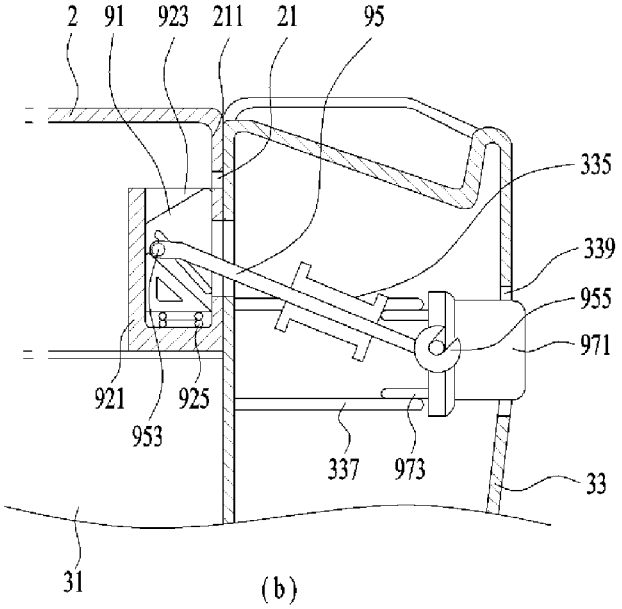
(b)

LAUNDRY TREATMENT APPARATUS

CROSS-REFERENCE TO RELATED APPLICATIONS

This application is a National Stage application under 35 U.S.C. § 371 of International Application No. PCT/KR2016/002028, filed Feb. 29, 2016, which claims priority under 35 U.S.C. 119(a) to Korean Application No. 10-2015-0028981, filed on Mar. 2, 2015. The disclosures of the prior applications are incorporated by reference in their entirety.

TECHNICAL FIELD

The present invention relates to a laundry treatment apparatus.

BACKGROUND ART

A laundry treatment apparatus is an electrical household appliance which maybe used for washing laundry. In some examples, a laundry treatment apparatus may be an apparatus for drying laundry, or an apparatus for washing and drying laundry.

In a front loading type laundry treatment apparatus, for example, a drum type washing machine, where laundry is introduced into the laundry treatment apparatus through the front of the apparatus, an introduction port, through which laundry is introduced into the laundry treatment apparatus, is lower than the waist of a user, with the result that the user must stoop to introduce laundry into the laundry treatment apparatus or to remove laundry from the laundry treatment apparatus, which is inconvenient.

Some conventional front loading type laundry treatment apparatuses are provided with a pedestal, which is disposed under the laundry treatment apparatus in order to increase the height of the introduction port of the laundry treatment apparatus.

DISCLOSURE OF INVENTION

Technical Problem

An object of the present invention devised to solve the problem lies in a laundry treatment apparatus that is capable of washing or drying laundry using a receiving unit configured to be pulled out from a cabinet.

Another object of the present invention devised to solve the problem lies in a laundry treatment apparatus that is capable of minimizing vibration of a receiving unit in a cabinet while washing or drying laundry.

A further object of the present invention devised to solve the problem lies in a laundry treatment apparatus that is capable of preventing a receiving unit from moving out from a cabinet while washing or drying laundry.

Solution to Problem

The object of the present invention can be achieved by providing a laundry treatment apparatus including a cabinet; a drawer configured to be withdrawable from the cabinet; an introduction port provided in an upper surface of the drawer; a drum that is located in the drawer and that is configured to communicate with the introduction port; a driving shaft provided at a bottom surface of the drum; a driving unit configured to rotate the driving shaft; a push unit that is provided at the drawer and that is configured to allow an external force to be applied to the push unit; a fastening unit configured to perform a linear reciprocating motion in a direction perpendicular to a direction in which the drawer is withdrawn from the cabinet; and a transfer unit that is configured to connect the push unit and the fastening unit to each other, and that is configured to separate the fastening unit from the cabinet based on the external force being applied to the push unit.

The fastening unit may be located higher than the driving unit.

The fastening unit may be provided at the upper surface of the drawer.

The fastening unit may be part of multiple fastening units and at least two of the multiple fastening units are provided at each side surface of the drawer.

The cabinet may include an open surface that defines an introduction port of the drawer, the drawer may include a drawer body configured to provide a space in which the drum is received, and a drawer panel that is separably fixed to the drawer body and that is configured to open and close the open surface, the push unit may be configured to extend through the drawer panel and to perform a reciprocating motion in the direction in which the drawer is withdrawn from the cabinet, the fastening unit may be located at an upper surface of the drawer body, and the push unit and the transfer unit may be exposed outward based on the drawer panel being separated from the drawer body.

The laundry treatment apparatus may further include a receiving unit that is fixed to the upper surface of the drawer and that is configured to guide a movement of the fastening unit.

The receiving unit may include a receiving body that is configured to provide a space to receive the fastening unit; and an elastic support unit that is provided in the receiving body and that is configured to push the fastening unit in a same direction as the direction the fastening unit moves out from the receiving body, and the fastening unit may include a fastening body that is provided in the receiving body and that is configured to separably couple with the cabinet, and a guide, to which the transfer unit is coupled, that is configured to move the fastening body into the receiving body based on the external force being applied to the push unit.

The fastening unit may further include an inclined surface provided at an upper end of the fastening body such that the inclined surface is inclined downward in a direction in which the drawer is inserted into the cabinet.

The transfer unit may include a transfer body located between the guide and the push unit; a first connection unit that is provided at the transfer body and that is configured to couple with the guide; and a second connection unit configured to rotatably couple the transfer body to the push unit.

The first connection unit may include a protrusion configured to extend from the transfer body, and the guide may include a recess provided to be inclined upward in a direction in which the drawer is inserted for receiving the protrusion.

Advantageous Effects of Invention

As is apparent from the above description, the present invention has the effect of providing a laundry treatment apparatus that is capable of washing or drying laundry using a receiving unit configured to be pulled out from a cabinet.

In addition, the present invention has the effect of providing a laundry treatment apparatus that is capable of minimizing vibration of a receiving unit in a cabinet while washing or drying laundry.

Furthermore, the present invention has the effect of providing a laundry treatment apparatus that is capable of preventing a receiving unit from moving out from a cabinet while washing or drying laundry.

BRIEF DESCRIPTION OF DRAWINGS

FIGS. 1 and 2 are views showing an example of a laundry treatment apparatus; and FIG. 3 is a view showing the operation of a withdrawal prevention unit provided in the laundry treatment apparatus.

BEST MODE FOR CARRYING OUT THE INVENTION

As shown in FIG. 1, the laundry treatment apparatus 100 may include a first treatment device L and a second treatment device T. In some examples, a laundry treatment apparatus 100 may include only a first treatment device L.

The first treatment device L is a device that treats, for example, washes or dries laundry, and the second treatment device T is a device that is separably mounted to the first treatment device L in order to treat laundry.

As shown in FIG. 2, the second treatment device T may include a second cabinet 1 forming the external appearance of the second treatment device T, a second tub 15 provided in the second cabinet 1 for receiving wash water, a second drum 16 rotatably provided in the second tub 15 for providing a laundry receiving space, a second water supply unit 17 for supplying wash water to the second tub 15, and a second drainage unit 18 for discharging wash water received in the second tub 15 out of the second cabinet 1.

The second cabinet 1 is provided with a second treatment device introduction port 19, through which laundry is introduced into or removed from the second treatment device T. The second treatment device introduction port 19 is opened and closed by a second treatment device door 11, which is hingedly coupled to the second cabinet 1.

The second treatment device introduction port 19 communicates with the interior of the second drum 16 through a second tub introduction port, which is provided in the second tub 15, and a second drum introduction port, which is provided in the second drum 16. A user may open the second treatment device door 11 in order to introduce laundry into the second drum 16 or to remove the laundry received in the second drum 16 out of the second cabinet 1.

In some examples, where the second treatment device T is configured to have a function of drying laundry in addition to a function of washing laundry, a second hot air supply device for supplying heated air into the second tub 15 may be further provided in the second cabinet 1.

The second hot air supply device may include a circulation duct for circulating air in the second tub 15 and a heat exchange unit provided in the circulation duct for dehumidifying and heating air discharged from the second tub 15.

The second hot air supply device may include a discharge duct for discharging air in the second tub 15 out of the second cabinet 1, a supply duct for supplying air outside the second cabinet 1 into the second tub 15, and a heat exchange unit provided in the supply duct for heating air that is introduced into the supply duct.

In some examples, the second treatment device T may be configured only to dry laundry, the second tub 15 may be omitted from the second treatment device T. In these examples, a member for rotatably supporting the second drum 16 may be further provided in the second treatment device T. In addition, the second hot air supply device may be configured to supply hot air to the second drum 16.

As shown in FIG. 1, the first treatment device L includes a cabinet 2 for supporting the second cabinet 1, a drawer 3 provided in the cabinet 2 to be pulled out from the cabinet 2, and a receiving unit 4 and 5 provided in the drawer 3 for providing a laundry treatment space.

The cabinet 2 forms the external appearance of the first treatment device L. The cabinet 2 may be located on the second treatment device T. Alternatively, the cabinet 2 may be located under the second treatment device T.

In some examples, the first treatment device L is located under the second treatment device T, as shown in FIG. 1, the height of the second treatment device door 11 is increased due to the first treatment device L, with the result that it is possible for the user to conveniently introduce laundry into the second treatment device T or to conveniently remove the laundry from the second treatment device T. In addition, it is possible to attenuate vibrate generated from the first treatment device L by virtue of the weight of the second treatment device T. Furthermore, it is possible to prevent the second treatment device T from being inclined to a direction in which the drawer 3 is pulled out, when pulling out the drawer 3, by virtue of the weight of the second treatment device T.

The cabinet 2 is provided with an open surface 21, through which the drawer 3 may be pulled out from the cabinet 2 or inserted into the cabinet 2. In this case, the open surface 21 may be provided in a direction in which the second treatment device door 11 is located (i.e. the front surface of the second treatment device T).

The drawer 3 includes a drawer body 31, the upper surface of which is open, and a drawer cover 35 provided at the open surface of the drawer body 31.

The drawer body 31 may be configured to have a hexahedral shape having an empty space defined therein. The drawer cover 35 is fixed to the drawer body 31 in order to form the upper surface of the drawer body 31.

A drawer panel 33 is provided at the front surface of the drawer body 31. The drawer panel 33 is a member for opening and closing the open surface 21 of the cabinet 2 and, in addition, for pulling out the drawer body 31 from the cabinet 2 or inserting the drawer body 31 into the cabinet 2. The drawer panel 33 may be separably coupled to the drawer body 31.

The drawer panel 33 may be provided with a control panel 331 for controlling the operation of the first treatment device L. The control panel 331 is provided to allow the user to input a control command necessary to control components (a water supply unit and a drainage unit) for supplying wash water to the receiving unit 4 and 5 and discharging wash water from the receiving unit 4 and 5, a component (a driving unit) for rotating laundry, and components (a hot air supply device and a moisture supply device) for supplying hot air and steam to laundry.

In addition, the control panel 331 may be provided with an input unit 332 for allowing the user to input a control command to the first treatment device L and a display unit 333 for allowing the user to confirm the control command input through the input unit 332 or notifying the user of the progress of execution of the control command input by the user. That is, the display unit 333 may display information about the operation of the first treatment device L.

The drawer cover 35 may be provided with an introduction port 353 formed through the drawer cover 35 for allowing the interior of the drawer body 31 and the exterior of the drawer body 31 to communicate with each other and a water supply port 355 formed through the drawer cover 35 for guiding wash water to the receiving unit 4 and 5.

As shown in FIG. 2, the receiving unit 4 and 5, which is provided in the drawer 3, may include a tub 4 provided in the drawer body 31 for providing a wash water receiving space and a drum 5 rotatably provided in the tub 4 for receiving laundry.

The tub 4 is fixed to the drawer 3 via a tub support unit 48. The tub support unit 48 connects the tub 4 and the drawer 3 to each other such that the circumferential surface of the tub 4 is supported by the drawer 3. The tub support unit 48 may be provided with a member for attenuating vibration.

A door 49 for allowing the interior of the tub 4 and the exterior of the tub 4 to communicate with each other is provided at the upper surface of the tub 4.

The door 49 is rotatably provided at the upper surface of the tub 4 (i.e. the door 49 is provided in order to open and close a portion of the upper surface of the tub 4). The door 49 may be pulled out from the drawer 3 (for example, by hinge rotation) through the introduction port 353, which is provided in the drawer cover 35. After pulling out the drawer 3 from the cabinet 2, therefore, the user may open the door 49 in order to introduce laundry into the tub 4.

The tub 4 is provided in the upper surface thereof with an inlet port 47, through which wash water supplied through the water supply port 355, provided in the drawer 3, is introduced into the tub 4. A pipe for connecting the water supply port 355 to the upper surface of the tub 4 may be provided as the inlet port 47. Alternatively, a hole formed through the upper surface of the tub 4 may be provided as the inlet port 47. The hole may be located under the water supply port 355.

The drum 5 may be configured to have the shape of a cylinder, the upper surface of which is open. The drum 5 may be rotated in the tub 4 by a driving unit 6, which is provided outside the tub 4.

The driving unit 6 may include a stator 61 fixed to the tub 4 for generating a rotating magnetic field and a rotor 63 configured to be rotated by the rotating magnetic field. A driving shaft 53, which is fixed to the bottom surface of the drum 5 through the tub 4, is connected to the rotor 63.

As shown in the figure, the driving shaft 53 may be provided so as to be perpendicular to the bottom surface of the drawer 3.

Drum through holes 51 for allowing the interior of the drum 5 and the interior of the tub 4 to communicate with each other are provided in the outer circumferential surface of the drum 5.

As described above, the receiving unit includes the tub 4 and the drum 5 such that the first treatment device L may be capable of performing a washing function. In addition, a hot air supply device for supplying hot air to the tub 4 may be further provided in the cabinet 2 such that the first treatment device L is also capable of performing a drying function.

In some examples where the first treatment device L is configured only to dry laundry, the receiving unit may include only the drum 5, and the hot air supply device provided in the first treatment device L may be configured to supply hot air to the drum 5.

The first treatment device L is connected via a water supply unit 7 to a water source located outside the laundry treatment apparatus 100. The water supply unit 7 may include a water supply pipe 71 for connecting the water supply port 355 to the water source and a valve 73 for opening and closing the water supply pipe 71 under the control of a controller.

Wash water received in the tub 4 is discharged out of the cabinet 2 through a drainage unit 8. The drainage unit 8 may include a drainage pipe 83 for guiding the wash water in the tub 4 out of the cabinet 2 and a pump 81 provided in the drainage pipe 83 for discharging the wash water from the tub 4 (under the control of the controller).

The driving unit 6 is fixed to the tub 4, and the tub 4 is fixed to the drawer 3 via the tub support unit 48. In the first treatment device L with the above-stated construction, therefore, vibration generated from the drum 5 or the tub 4 when the drum 5 is rotated by the driving unit 6 may be transmitted to the drawer 3.

When the vibration generated from the drum 5 or the tub 4 due to the operation of the driving unit 6 is transmitted to the drawer 3, the drawer 3 may collide with the cabinet 2, with the result that noise or vibration may be generated from the drawer 3 and the cabinet 2. Furthermore, during the rotation of the driving unit 6, the drawer 3 may move out from the cabinet 2.

The laundry treatment apparatus 100 may further include an attachment and detachment unit 9 for preventing the drawer 3 from moving out from the cabinet 2 and, in addition, for minimizing vibration of the drawer 3 in the cabinet 2.

As previously described, the first treatment device L is configured to have a structure in which the door 49, which is configured to be opened for the user to introduce laundry into the drum 5, is provided at the upper surface of the tub 4, and in which the driving unit 6, which rotates the drum 5, is provided at the bottom surface of the tub 4.

That is, since the driving shaft 53, which rotates the drum 5, is connected to the bottom surface of the drum 5 through the bottom surface of the tub 4, the fluctuation of the drum 5 (the change in distance between the outer circumferential surface of the drum and the inner circumferential surface of the tub), which is a main vibration source of the first treatment device L, may gradually increase from the bottom surface of the drum 5 to the upper end of the drum 5.

In consideration of the fact that the amplitude of the drum 5 gradually increases from the bottom surface of the drum 5 to the upper end of the drum 5 in the structure of the first treatment device L, it is possible to effectively prevent the drawer 3 from vibrating in the cabinet 2 or to effectively prevent the drawer 3 from moving out from the cabinet 2 when the attachment and detachment unit 9 is located higher than the driving unit 6.

The attachment and detachment unit 9 may be provided to fix the upper surface of the drawer 3 to the inside upper surface of the cabinet 2. Alternatively, the attachment and detachment unit 9 may be provided to fix opposite side surfaces of the drawer 3 to corresponding side surfaces of the cabinet 2. In the following description, the attachment and detachment unit 9 is provided at the upper surface of the drawer 3 to fix the drawer 3 to the cabinet 2.

As shown in FIG. 3, the attachment and detachment unit 9 may include a fastening unit 91 provided at the drawer 3 for selectively coupling the drawer 3 to the cabinet 2, a push unit 97 provided at the drawer 3 for allowing external force to be applied thereto, and a transfer unit 95 for separating the fastening unit 91 from the cabinet 2 when external force is applied to the push unit 97.

The fastening unit 91 is characterized in that the fastening unit 91 performs a linear reciprocating motion in a direction perpendicular to a direction in which the drawer 3 moves.

The reason that the fastening unit 91 is configured to perform the linear reciprocating motion in the direction perpendicular to the direction in which the drawer 3 moves is that it is possible for a fastening member, reciprocating in a direction perpendicular to the direction in which the drawer 3 moves, to minimize the distance between the cabinet 2 and the fastening member (i.e. to minimize the generation of vibration from the cabinet 2 and the drawer 3), as compared with a handle type fastening member (which is configured such that a body rotating about a rotational shaft provided at the drawer fixes the drawer to the cabinet).

The fastening unit 91 may include a fastening body 911 separably coupled to the cabinet 2, an inclined surface 915 provided at the fastening body 911, and a guide 913 provided at the fastening body 911 such that the transfer unit 95 is connected to the guide 913.

The fastening body 911, which performs the linear reciprocating motion in the direction perpendicular to the direction in which the drawer 3 moves, is guided by a receiving unit 92 provided at the upper surface of the drawer 3 (i.e. at the drawer cover 35).

In this case, the cabinet 2 may be further provided with a coupling unit for providing a space in which the outer circumferential surface of the fastening body 911 is received or a coupling unit 211 for supporting the outer circumferential surface of the fastening body 911.

In a case in which the coupling unit 211 is configured to support the outer circumferential surface of the fastening body 911, the coupling unit 211 may protrude from the open surface 21 of the cabinet 2 toward the drawer 3.

The receiving unit 92 may include a receiving body 921 fixed to the drawer cover 35, a receiving recess 923 provided in the receiving body 921 for receiving the fastening body 911, and an elastic support unit 925 located in the receiving recess 923 for supporting the fastening body 911.

The receiving recess 923 may be formed to have a shape configured such that the surface of the receiving recess 923 facing the cabinet 2 is open, and a spring for pushing the fastening body 911 toward the cabinet 2 (i.e. pushing the fastening body 911 such that the fastening body 911 moves out from the receiving recess 923) may be provided as the elastic support unit 925.

The inclined surface 915, which is provided at the upper end of the fastening body 911, may be inclined downward in a direction in which the drawer 3 is inserted. In this structure, when the drawer 3 is moved into the cabinet 2 (i.e. when the user pushes the drawer 3 into the cabinet 2), the fastening body 911 may move toward the receiving unit 92 along the inclined surface 915 even though the user does not push the push unit 97.

The guide 913 is configured to connect the fastening body 911 to the transfer unit 95. The guide 913 may be inclined upward in the direction in which the drawer 3 is inserted.

The push unit 97 is configured to move the fastening body 911 into the receiving recess 923 through the transfer unit 95. The push unit 97 includes a push body 971, which is movable in the drawer panel 33.

The push body 971 may be configured to perform a linear reciprocating motion in a direction parallel to the direction in which the drawer 3 moves. In this case, the drawer body 31 may be further provided with a push unit guide 337 for providing a path along which the push body 971 moves, and the drawer panel 33 may be further provided with a body through hole 339, through which the push body 971 extends.

The push unit guide 337 may be configured to support the circumferential surface of the push body 971. Specifically, as shown in FIG. 3, the push unit guide 337 may be configured to support a support unit 973 protruding from the push body 971.

The transfer unit 95 may include a bar type transfer body 951 for transferring external force applied to the push body 971 (i.e. force applied in a direction parallel to the direction in which the drawer 3 moves) to the fastening body 911 (i.e. transferring the external force in a direction perpendicular to the direction in which the drawer 3 moves).

In this case, the drawer panel 33 may be further provided with a transfer unit guide 335 for providing a path along which the transfer body 951 moves.

One end of the transfer body 951 may be rotatably coupled to the push body 971, and the other end of the transfer body 951 may be movably coupled to the guide 913 of the fastening unit 91. That is, the transfer body 951 is coupled to the push body 971 via a second connection unit 955, and is coupled to the guide 913 via a first connection unit 953.

The first connection unit 953 may be provided so as to move along the inside of the guide 913. In a case in which the first connection unit 953 is configured as a protrusion protruding from the transfer body 951, therefore, the guide 913 may be configured as a recess for receiving the protrusion.

Furthermore, the tilt angle of the guide 913 may be greater than that of the transfer body 951. When external force is applied to the push unit 97, therefore, the fastening body 911 may move into the receiving body 921 due to the guide 913 and the first connection unit 953.

The second connection unit 955 may be configured to have any shape as long as the transfer body 951 can be rotatably coupled to the push body 971 by the second connection unit 955.

When the user pushes the push body 971 while the first treatment device L is in a state shown in FIG. 3(*a*), the transfer body 951 moves away from the drawer panel 33. As the transfer body 951 moves away from the drawer panel 33, the first connection unit 953 pushes the guide 913.

As the guide 913 is pushed by the first connection unit 953, the fastening body 911 moves into the receiving recess 923 while compressing the elastic support unit 925, with the result that the drawer 3 is in a state in which the drawer 3 is separable from the cabinet 2 (see FIG. 3(*b*)).

When the external force is released from the push body 971 in a state shown in FIG. 3(*b*), the elastic support unit 925 pushes the fastening body 911, and the fastening body 911 pushes the transfer body 951. As a result, the push body 971 returns to the position shown in FIG. 3(*a*).

The attachment and detachment unit 9 may be fixed to the drawer body 31 such that the attachment and detachment unit 9 can be exposed outward when the drawer panel 33 is separated from the drawer body 31.

As previously described, the drawer panel 33 is a member for opening and closing the open surface 21 of the cabinet 2 and, in addition, for pulling out the drawer body 31 from the cabinet 2. The drawer panel 33 is separably coupled to the drawer body 31. Consequently, the drawer panel 33 is provided outside the cabinet 2 in an exposed state in order to form a surface facing the open surface 21 of the cabinet 2.

In a case in which the fastening unit 91, the transfer unit 95, and the push unit 97 are configured so as to be exposed outside the cabinet 2 when the drawer panel 33 is separated from the drawer body 31, therefore, it is possible to easily inspect and repair the attachment and detachment unit 9.

In addition, the attachment and detachment unit 9 may be located in front of the drawer body 31 rather than behind the drawer body 31.

Most apparatuses have an assembly tolerance. The more complicated the structure of the apparatus is, the higher the assembly tolerance is. In the first treatment device L, the number of parts coupled to the front of the drawer body 31 is greater than the number of parts coupled to the rear of the drawer body 31.

That is, the drawer panel 31 is provided at the front of the drawer body 31, whereas the water supply unit 7 and the drainage unit 8 are provided at the rear of the drawer body 31. As a result, the sum of the assembly tolerances of the respective parts coupled to the rear of the drawer body 31 may be greater than the sum of the assembly tolerances of the respective parts coupled to the front of the drawer body 31.

The increase in sum of the assembly tolerances may cause a failure of coupling between two parts that are configured to be selectively coupled to each other. In order to overcome this problem, the attachment and detachment unit 9 may be located in front of the drawer 3 rather than behind the drawer 3.

Although implementations have been illustrated and described above, it will be apparent to those skilled in the art that the implementations are provided to assist understanding of the present disclosure and the present disclosure is not limited to the above described implementations. Various modifications and variations can be made without departing from the spirit or scope of the present disclosure.

The invention claimed is:

1. A laundry treatment apparatus comprising:

a cabinet;

a drawer configured to be withdrawable from the cabinet;

an introduction port provided in an upper surface of the drawer;

a drum that is located in the drawer and that is configured to communicate with the introduction port;

a driving shaft provided at a bottom surface of the drum;

a driving unit configured to rotate the driving shaft;

a push unit that is disposed at the drawer and that is configured to reciprocate in a first direction parallel to a direction of an external force applied to the push unit;

a fastening unit disposed at the drawer and spaced apart from the push unit; and a transfer unit that is configured to connect the push unit and the fastening unit to each other, and that is configured to cause the fastening unit to reciprocate in a second direction and separate the fastening unit from the cabinet based on the external force being applied to the push unit, wherein the transfer unit comprises:

a transfer body that connects the fastening unit with the push unit and that is configured to transfer the external force applied to the push unit to the fastening unit;

a first connection unit located at the transfer body and configured to be mounted on the fastening unit; and a second connection unit located at the transfer body and configured to rotatably connect the transfer body with the push unit, and wherein a first end of the transfer body is coupled to the push unit, and a second end of the transfer body is coupled to the fastening unit.

2. The laundry treatment apparatus according to claim 1, wherein the fastening unit is located higher than the driving unit.

3. The laundry treatment apparatus according to claim 2, wherein the fastening unit is provided at the upper surface of the drawer.

4. The laundry treatment apparatus according to claim 2, wherein the fastening unit is provided on a side surface of the drawer.

5. The laundry treatment apparatus according to claim 2, wherein:

the cabinet comprises an open surface that defines an introduction port of the drawer, the drawer comprises a drawer body configured to provide a space in which the drum is received, and a drawer panel that is separably fixed to the drawer body and that is configured to open and close the open surface, the push unit is configured to extend through the drawer panel and to perform a reciprocating motion in the direction in which the drawer is withdrawn from the cabinet, the fastening unit is located at an upper surface of the drawer body, and the push unit and the transfer unit are exposed outward based on the drawer panel being separated from the drawer body.

6. The laundry treatment apparatus according to claim 2, further comprising a receiving unit that is fixed to the upper surface of the drawer and that is configured to guide a movement of the fastening unit.

7. The laundry treatment apparatus according to claim 6, wherein:

the receiving unit comprises a receiving body that is configured to provide a space to receive the fastening unit; and an elastic support unit that is provided in the receiving body and that is configured to push the fastening unit in a same direction as the direction the fastening unit moves out from the receiving body, and the fastening unit comprises a fastening body that is provided in the receiving body and that is configured to separably couple with the cabinet, and a guide, to which the transfer unit is coupled, that is configured to move the fastening body into the receiving body based on the external force being applied to the push unit.

8. The laundry treatment apparatus according to claim 7, wherein the fastening unit further comprises an inclined surface provided at an upper end of the fastening body such that the inclined surface is inclined downward in a direction in which the drawer is inserted into the cabinet.

9. The laundry treatment apparatus according to claim 7, wherein the transfer unit comprises:

the transfer body located between the guide and the push unit.

10. The laundry treatment apparatus according to claim 9, wherein:

the first connection unit comprises a protrusion configured to extend from the transfer body, and the guide comprises a recess provided to be inclined upward in a direction in which the drawer is inserted for receiving the protrusion.

11. The laundry treatment apparatus according to claim 1, wherein the first direction and the second direction are different from each other.

12. A laundry treatment apparatus comprising:

a cabinet;

a drawer configured to be withdrawable from the cabinet;

an introduction port provided in an upper surface of the drawer;

a drum that is located in the drawer and that is configured to communicate with the introduction port;

a driving shaft provided at a bottom surface of the drum;

a driving unit configured to rotate the driving shaft;

a push unit that is provided at the drawer and that is configured to allow an external force to be applied to the push unit;

a fastening unit configured to perform a linear reciprocating motion in a direction perpendicular to a direction in which the drawer is withdrawn from the cabinet;

a transfer unit that is configured to connect the push unit and the fastening unit to each other, and that is configured to separate the fastening unit from the cabinet based on the external force being applied to the push unit; and a receiving unit that is fixed to the upper surface of the drawer and that is configured to guide a movement of the fastening unit, wherein the fastening unit is located higher than the driving unit, wherein the receiving unit comprises a receiving body that is configured to provide a space to receive the fastening unit, and an elastic support unit that is provided in the receiving body and that is configured to push the fastening unit in a same direction as the direction the fastening unit moves out from the receiving body, and wherein the fastening unit comprises a fastening body that is provided in the receiving body and that is configured to separably couple with the cabinet, and a guide, to which the transfer unit is coupled, that is configured to move the fastening body into the receiving body based on the external force being applied to the push unit.

* * * * *